US009334585B2

(12) United States Patent
Glawion et al.

(10) Patent No.: US 9,334,585 B2
(45) Date of Patent: May 10, 2016

(54) SPINNING BATH VAT

(75) Inventors: Erwin Glawion, Grossostheim (DE); Dieter Zenker, Köln (DE)

(73) Assignee: TRUETZSCHLER NONWOVENS GMBH, Egelsbach (DE)

( * ) Notice: Subject to any disclaimer, the term of this patent is extended or adjusted under 35 U.S.C. 154(b) by 0 days.

(21) Appl. No.: 14/126,062

(22) PCT Filed: Jun. 6, 2012

(86) PCT No.: PCT/EP2012/060686

§ 371 (c)(1),
(2), (4) Date: Dec. 13, 2013

(87) PCT Pub. No.: WO2012/171835

PCT Pub. Date: Dec. 20, 2012

(65) Prior Publication Data

US 2014/0141111 A1 May 22, 2014

(30) Foreign Application Priority Data

Jun. 15, 2011 (DE) ..... 10 2011 104 194

(51) Int. Cl.
*D01D 5/04* (2006.01)
*D01D 5/06* (2006.01)
*D01D 5/088* (2006.01)

(52) U.S. Cl.
CPC .. *D01D 5/06* (2013.01); *D01D 5/04* (2013.01); *D01D 5/0885* (2013.01)

(58) Field of Classification Search
CPC ..... D01D 5/04; D01D 5/06; D01D 5/0885
USPC ..... 425/67, 71; 264/178 F
See application file for complete search history.

(56) References Cited

U.S. PATENT DOCUMENTS

| | | | | |
|---|---|---|---|---|
| 2,370,721 | A * | 3/1945 | Dreyfus | 264/178 F |
| 2,746,839 | A * | 5/1956 | Terry et al. | 264/167 |
| 2,905,968 | A | 9/1959 | Waler et al. | |
| 3,389,428 | A * | 6/1968 | Denti et al. | 425/71 |
| 3,414,939 | A * | 12/1968 | Chirgwin, Jr. | 425/71 |
| 3,621,088 | A * | 11/1971 | Hatcher et al. | 264/78 |
| 5,279,783 | A * | 1/1994 | Liu et al. | 264/178 F |
| 5,785,997 | A * | 7/1998 | Budenbender et al. | 425/71 |
| 5,984,655 | A | 11/1999 | Schwenninger et al. | |
| 7,150,614 | B2 * | 12/2006 | Sadinski | 425/4 C |
| 2012/0112381 | A1 * | 5/2012 | Wollner et al. | 264/178 F |

FOREIGN PATENT DOCUMENTS

| | | |
|---|---|---|
| DE | 1102338 B | 3/1961 |
| DE | 1112604 B | 8/1961 |
| DE | 1123795 B | 2/1962 |

(Continued)

*Primary Examiner* — James Sanders
*Assistant Examiner* — Joseph Leyson
(74) *Attorney, Agent, or Firm* — FisherBroyles, LLP; Robert Kinberg

(57) ABSTRACT

The invention relates to a spinning bath vat, including a vat for taking up spinning bath liquid, at least one roller arranged within the vat for guiding the spun filaments, and an infeed and discharge system for spinning bath liquid. According to the invention, it is provided that the spinning bath vat (SBW) has a design which is useful both for wet spinning by means of a spinning nozzle (SD) arranged within the spinning bath liquid (SBF) and for dry/wet spinning by means of a spinning nozzle (SD) arranged above the spinning bath liquid (SBF).

4 Claims, 4 Drawing Sheets

(56) References Cited

FOREIGN PATENT DOCUMENTS

Figure 1:
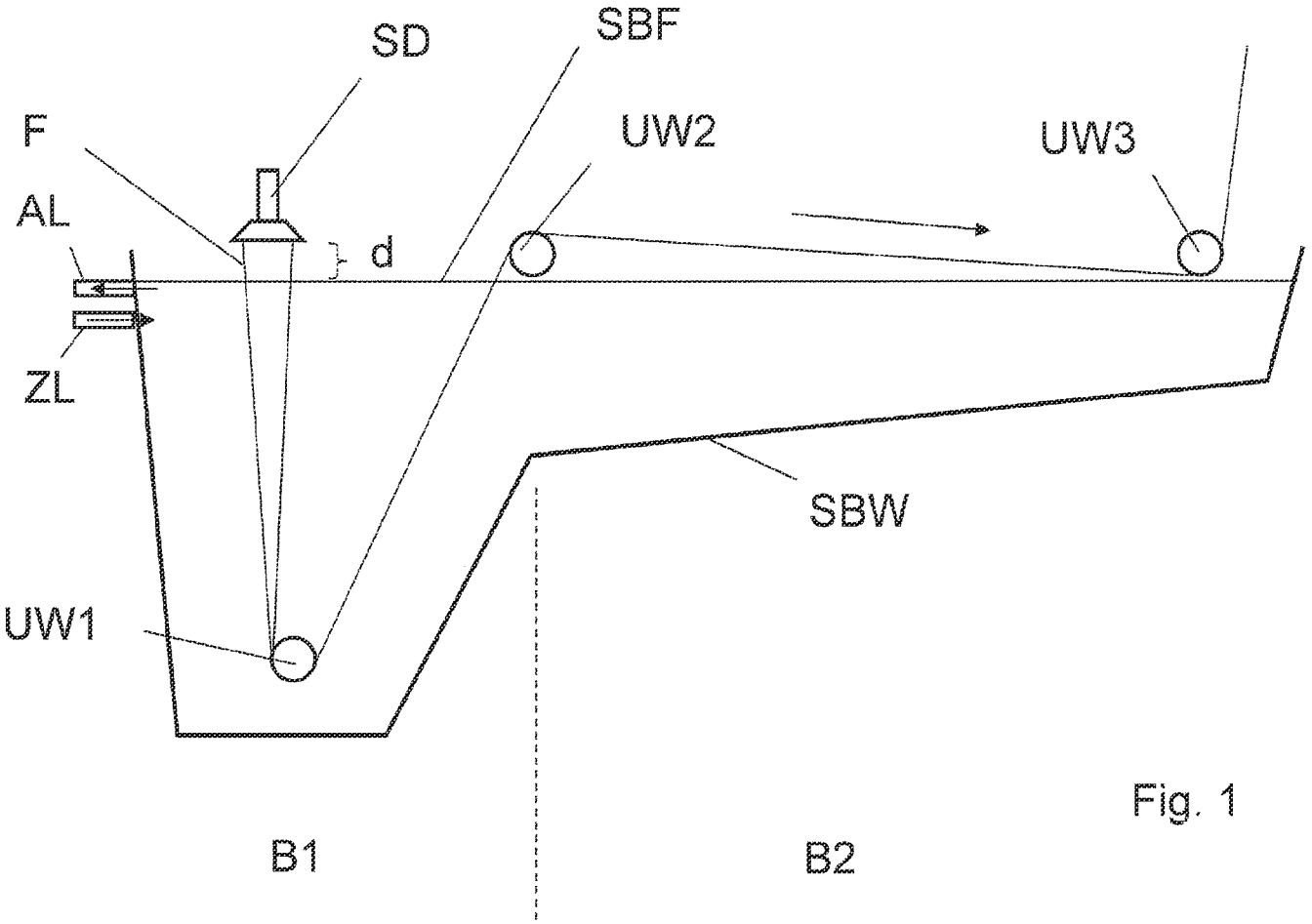

| | | | |
|---|---|---|---|
| DE | 19581437 | B4 | 4/2004 |
| GB | 550106 | A | 12/1942 |
| GB | 1540912 | A | 2/1979 |
| JP | 5044104 | B2 | 2/1993 |
| JP | 2004-52129 | A | 2/2004 |

* cited by examiner

SPINNING BATH VAT

The invention relates to a spinning bath vat including a vat for taking up spinning bath liquid, at least one roller arranged within the vat for guiding the spun filaments, and an infeed and discharge system for spinning bath liquid.

In pure wet spinning, a spinning nozzle is arranged within a spinning bath vat which is filled with a spinning bath liquid (precipitation bath). The medium to be spun will be supplied, with the aid of a pump and via a tube conduit, to the spinning nozzle which is fully immersed into the spinning bath liquid, and, via the spinning nozzle openings, will be extruded in the form of filaments directly into the spinning bath liquid. Within the spinning bath liquid, the filaments will coagulate.

DE-AS 1 102 338, DE-AS 1 112 604 and DE-PS 1 123 795 describe spinning nozzle arrangements which are located within a spinning bath vat and are entirely surrounded by spinning bath liquid. In these arrangements, the geometry of the spinning bath vat is such that the extruded filaments will run substantially horizontally and only after a distance, which is predetermined by the required coagulation time and the spinning speed, will be guided out of the spinning bath vat in a controlled manner via guide rollers. With the aid of a feed and discharge system in combination with a conditioning process, the required quality of the precipitation bath and the required filling level will always be maintained.

In dry/wet spinning, the spinning nozzle is positioned above a spinning bath liquid. Thus, between the bottom side of the spinning nozzle where the spinning nozzle openings are situated, and the top surface of the spinning bath liquid, an air gap exists. Therefore, the medium to be spun will first be extruded in a non-precipitable medium—the air gap—and subsequently will enter the precipitation bath in which the coagulation will take place.

In this type of spinning, the filaments will run vertically from above downward into the spinning bath and, within the bath, to a roller arranged within the spinning bath vat and then, while being guided about the roller, will be moved in an obliquely upward orientation out of the vat again. Also here, the filaments have to cover a certain distance within the bath to make it possible to achieve the required coagulation. DE 195 81 437 B4 shows a spinning nozzle situated above the spinning bath liquid and arranged at a predetermined distance to the surface of the liquid. The filaments will run vertically downward into the vat, around a roller in the vat, and then upward again and out of the bath.

The invention thus starts from a spinning bath vat comprising a vat for taking up spinning bath liquid, at least one roller arranged within the vat for guiding the spun filaments, and a feed and discharge system for spinning bath liquid.

It is an object of the invention to improve a generic device.

The above object is achieved by the features that the spinning bath trough has a design which is useful both for wet spinning by means of a spinning nozzle arranged within the spinning bath liquid and for dry/wet spinning by means of a spinning nozzle arranged above the spinning bath liquid.

Advantageous further embodiments of the invention include the following features.

The spinning bath trough can include, in the direction towards the spun filaments, a front-side first deep region and an ad-joining shallower region.

The spinning bath trough can include, in the first deep region, a deflection roller for guidance of the filaments generated in the dry/wet spinning.

The spinning bath trough can include at least one deflection roller serving for filament guidance both in dry/wet spinning and in wet spinning.

A shaped body can be adapted to be inserted into that region of the spinning bath trough which is not needed in the respective spinning method.

The deflection roller may include a drive of its own.

The drive may be a water-tight tubular motor.

According to the invention, it is provided that the geometry of the spinning bath vat makes it possible to arrange a spinning nozzle both for wet spinning and for dry/wet spinning. For this purpose, the spinning bath vat comprises the deflection rollers required for performing the respective spinning method, and respectively the holding portions for such rollers. The rollers are preferably rollers provided with a dedicated drive in the form of a watertight tubular drive.

In the geometric design of the spinning bath vat, the fact has been considered that, in wet/dry spinning methods, the filaments will run by a predetermined distance into the spinning bath and, after undergoing a first deflection, will move out of the spinning bath vat again. In correspondence thereto, the spinning bath vat in one region thereof has the required depth and, in this region, the vat comprises a holding portion for the deflection roller provided there.

Further, the spinning bath vat comprises at least one further holding portion for a deflection roller, namely above the vat and respectively the level of the liquid. Said roller is used, in the wet/dry spinning method, so that the filaments that have been guided out of the spinning bath liquid will be guided toward a rear deflection roller. Both in the wet/dry spinning method and in the pure wet spinning method, said rear roller serves for guiding the filaments toward the processing stations arranged further downstream.

The spinning bath vat of the invention comprises a front-side deep region which is used for filament guidance in the wet/dry spinning method. This region is not needed in case of pure wet spinning—in this case, the filaments will run, from a spinning nozzle arranged in the front area of the spinning bath vat below the surface of the liquid, while the filaments are following a substantially horizontal path and are first moving within the spinning bath liquid, to the rear deflection roller which will deflect the filaments upward for further processing.

For avoidance of dead water, i.e. water saturated with solvent depositing in said front-side deep region, it can be provided according to a further embodiment of the invention that, in pure wet spinning, this vat region is filled with a provided shaped piece or shaped body. Achieved thereby is a reduction of the spinning bath liquid existing in the vat, so that also less liquid will have to be circulated per time unit.

If the vat shall be used for the wet/dry spinning method, said shaped body will be removed and, in the front region of the vat, the entire depth will be available. Since, in the operating mode "wet/dry spinning method", the shallow rear region of the spinning bath vat is not needed, it is possible, for rendering said region inoperative, to provide a further shaped body by which this rear region of the spinning bath vat can be put out of operation.

According to a further embodiment of the invention, it can be provided that, for avoidance of dead water in the operating mode "wet spinning", a circulation of the spinning bath liquid is enforced in the front region by feed and discharge ducts.

By way of a survey, further embodiments of the invention are provided as follows:

The spinning bath vat comprises, in the direction towards the spun filaments, a front-side first deep region and an adjoining shallower region.

The spinning bath vat comprises, in said first deep region, a deflection roller for guidance of the filaments generated in the dry/wet spinning.

The spinning bath vat comprises at least one deflection roller serving for filament guidance both in dry/wet spinning and in wet spinning.

A shaped body adapted to be inserted into that region of the spinning bath vat which is not needed in the respective spinning method.

Said deflection roller comprises a drive of its own.

Said drive is a water-tight tubular motor.

Hereunder, an embodiment of the invention will be explained with reference to the drawings.

FIG. 1 shows a spinning bath vat SBW which in a front region B1—as viewed in the direction of the running filaments—has a larger depth than in the rear region B2. The spinning bath vat SBW is filled with a spinning bath liquid SBF which, via schematically outlined feed and discharge ducts ZL,AL is controlled with regard to its filling level and the solvent concentration. Above the spinning bath liquid SBF (the surface of this liquid) contained in the spinning bath vat SBW, a spinning nozzle SD is arranged, namely at a distance d to the surface of spinning bath liquid SBF. Said spinning nozzle SD is fed with the to-be-spun solution via a pump, not shown, and a feed duct.

The filaments F exiting at the bottom side of the spinning nozzle SD will be extruded in the air and, after air gap d, will enter the spinning bath liquid SBF where the coagulation will take place. The filaments F will run vertically downward into the depth of the front region B1 of spinning bath vat SBW and will be deflected at a deflection roller UW1 arranged at a low position, whereupon, while oriented obliquely upward, they will run out of the spinning bath liquid to a second deflection roller UW2 from which they will be guided to a third deflection roller UW3 arranged in the rear region of the spinning bath vat. Via this deflection roller UW3 arranged above the spinning bath liquid SBF, the filaments will be passed on to a subsequent processing station; in the illustrated embodiment, the filaments F will first run upward and subsequently—not shown—will be guided onward in the horizontal direction.

The spinning bath vat SBW in its front region B1 has a depth whose design is adapted to the dry/wet spinning process which is to be performed. In the rear region B2, following said front region B1, the spinning bath vat SBW is shallow; here, the design is adapted to the wet spinning process which is to be performed, wherein the filaments F will run substantially horizontally.

Figure 2:
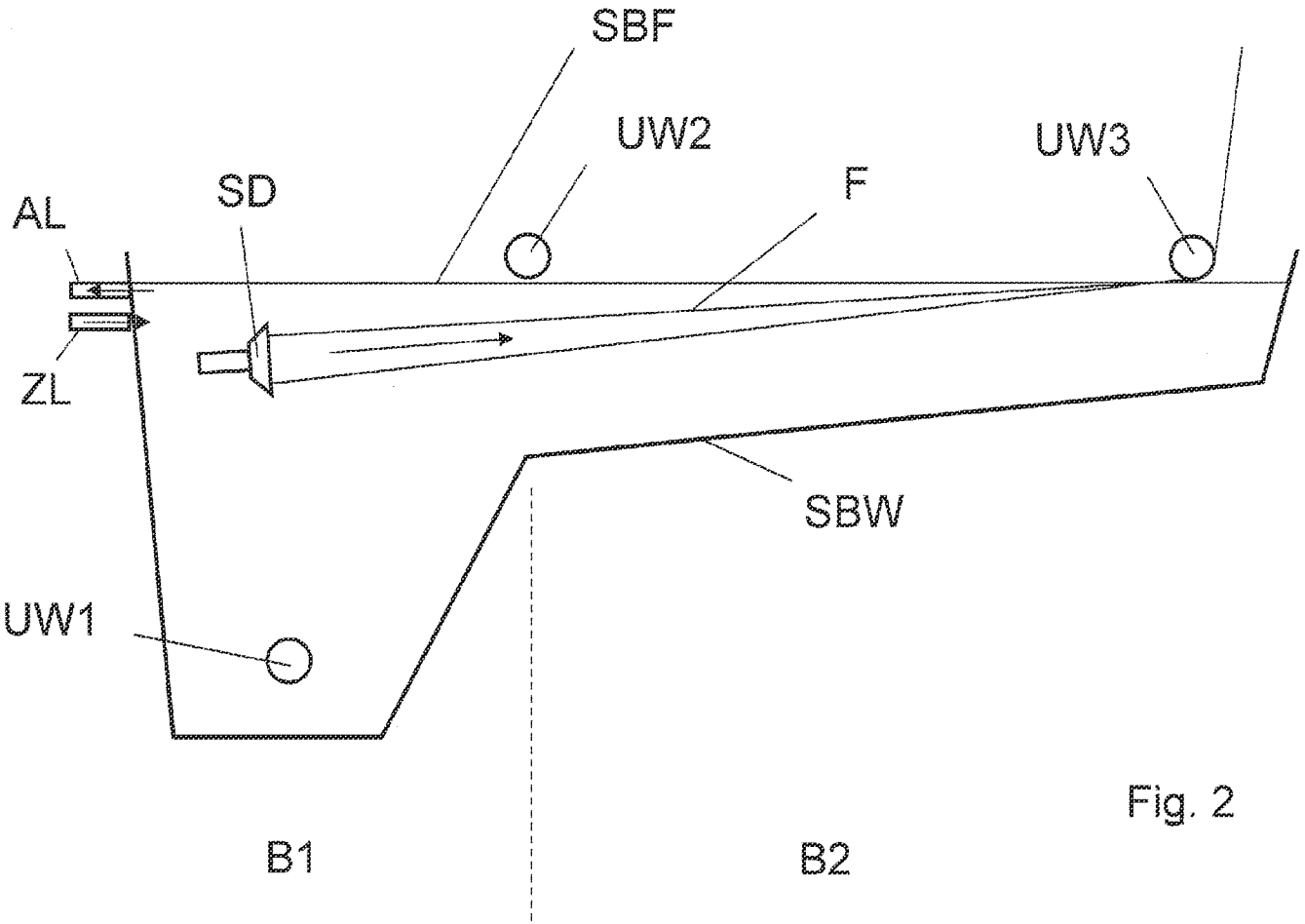

The moving path of the filament in the wet spinning process is shown in FIG. 2.

In wet spinning, a spinning nozzle SD is arranged below the surface of the spinning bath liquid SBF and will be supplied with the to-be-spun solution with the aid of a pump, not shown, and a feed line. The filaments F will be extruded directly into the spinning bath liquid SBF and will coagulate, and they will run at a flat rising angle upward to the third deflection roller UW3, from which, as in the above described dry/wet spinning process, they will be guided upward and to a further processing station, the washing baths. In the wet spinning process, the deflection rollers UW2 and UW3 are not needed and, since they are watertight, they can remain in the position required in the dry/wet spinning process.

Figure 3:
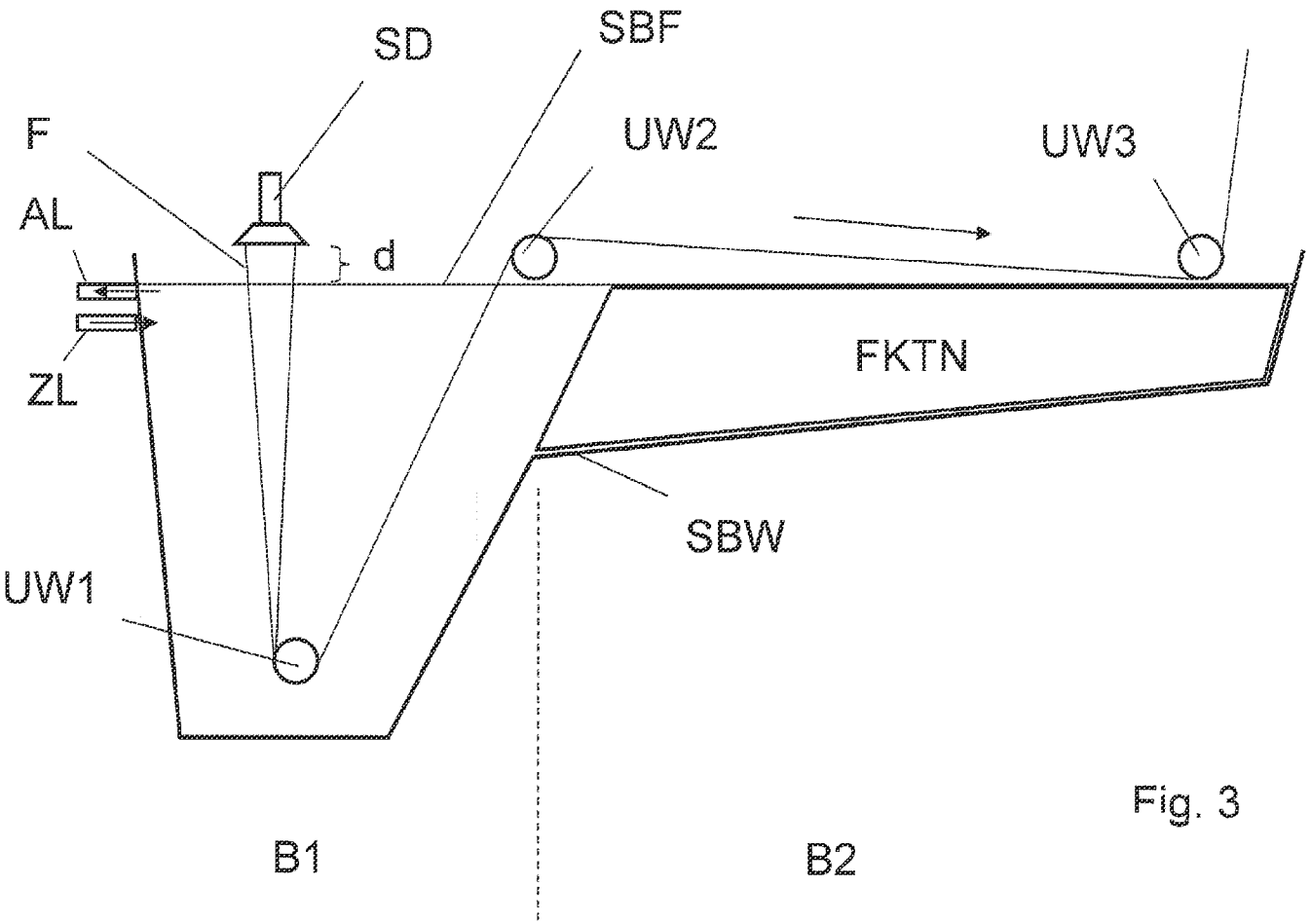

According to FIG. 3, the rear shallow region B2 of the spinning bath vat is not needed in the dry/wet spinning process. Into this region B2, there can be inserted a shaped body FKTN which displaces the spinning bath liquid in this region B2 and thus reduces the volume of the required liquid and of the liquid which must be recirculated. Finally, it is also prevented that a higher concentration of solvent might accumulate in the rear region B2 of the spinning bath vat SBW.

Figure 4:
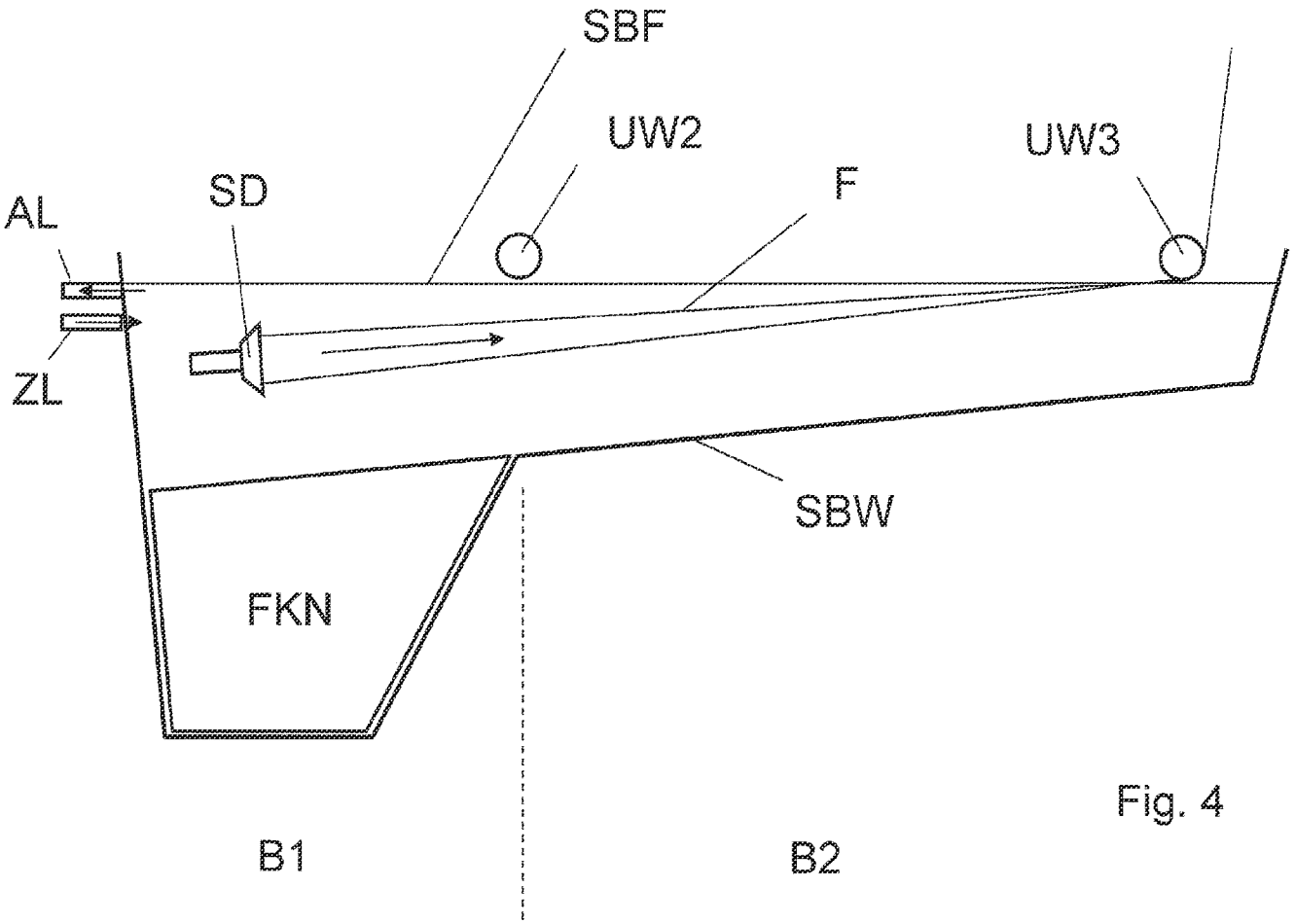

FIG. 4 illustrates the manner in which the spinning bath vat SBW is used in a pure wet spinning process. Into the front-side deeper region B1 of the spinning bath vat SBW, there is inserted—after removal of the first deflection roller UW1 which is no needed—a shaped body FKN which will fill out that portion of the spinning bath vat SBW which is not required in wet spinning, and thus will reduce the receiving volume of the spinning bath vat SBW.

LIST OF REFERENCE NUMERALS

SBW spinning bath vat
B1 front region of spinning bath vat, deep
B2 rear region of spinning bath vat, shallow
SBF spinning bath liquid, surface
ZL infeed duct
AL discharge duct
SD spinning nozzle
F filament
UW1 first deflection roller
UW2 second deflection roller
UW3 third deflection roller
d air gap, distance between spinning nozzle and spinning liquid

The invention claimed is:

1. A spinning bath vat system for wet spinning and for dry/wet spinning, comprising:

first and second spinning nozzles:

a vat for taking up spinning bath liquid, the spinning bath vat comprising, in a direction of travel of spun filaments, a front-side first deep region and an adjoining second shallower region, and an infeed and discharge system for spinning bath liquid, a first deflection roller provided in the first deep region for guidance of filaments generated in the dry/wet spinning;

a holding portion for a second deflection roller provided above the vat and above a level of spinning bath liquid in the vat; and at least one third deflection roller serving for filament guidance both in dry/wet spinning and in wet spinning;

wherein for dry/wet spinning the first spinning nozzle is arranged above the deep region of the spinning vat to project the spun filament in the direction of the first deflection roller, which deflects the spun filament toward the second deflection roller for deflection toward the third deflection roller, and for wet spinning the second spinning nozzle is arranged in a shallow region of the deep region of the vat above the first deflection roller to project a spun filament directly toward the third roller, bypassing the first and second deflection rollers.

2. The spinning bath vat system of claim 1, wherein a shaped body is provided, adapted to be inserted into that region of the spinning bath vat which is not needed in the respective spinning method.

3. The spinning bath vat system of claim 1, wherein said first deflection roller comprises a drive of its own.

4. The spinning bath vat system of claim 3, wherein said drive is a water-tight tubular motor.

* * * * *